US010178889B2

(12) United States Patent
Wacter et al.

(10) Patent No.: US 10,178,889 B2
(45) Date of Patent: Jan. 15, 2019

(54) CUSTOMIZABLE HEAD PROTECTION

(76) Inventors: Brian Wacter, Ladera Ranch, CA (US); Alison Hilda Wacter, Ladera Ranch, CA (US)

( * ) Notice: Subject to any disclaimer, the term of this patent is extended or adjusted under 35 U.S.C. 154(b) by 104 days.

(21) Appl. No.: 13/563,710

(22) Filed: Jul. 31, 2012

(65) Prior Publication Data

US 2013/0031700 A1 Feb. 7, 2013

(51) Int. Cl.
*A42B 3/00* (2006.01)
*A63B 71/10* (2006.01)
*A42B 3/32* (2006.01)

(52) U.S. Cl.
CPC ..... *A42B 3/32* (2013.01); *A42B 3/322* (2013.01)

(58) Field of Classification Search
CPC ..... A42B 3/12; A42B 3/125; A42B 3/127; A42B 3/128
USPC ..... 2/411, 414, 425, 410, 171.5–6, 181.4
See application file for complete search history.

(56) References Cited

U.S. PATENT DOCUMENTS 1,456,183 A * 5/1923 Knight ..... 2/412
3,286,275 A * 11/1966 Marchello ..... 2/411
5,014,365 A * 5/1991 Schulz ..... A42B 3/122 2/412
5,544,367 A * 8/1996 March, II ..... A42B 3/00 2/410
5,628,071 A * 5/1997 Nezer ..... A42B 3/322 2/410
5,661,854 A * 9/1997 March, II ..... 2/410
5,930,840 A * 8/1999 Arai ..... 2/411
6,065,159 A * 5/2000 Hirsh ..... 2/425
6,266,827 B1 * 7/2001 Lampe et al. ..... 2/414
6,272,692 B1 * 8/2001 Abraham ..... A42B 3/063 2/411
6,381,760 B1 * 5/2002 Lampe ..... A42B 3/00 2/414
6,625,820 B1 * 9/2003 Lampe ..... 2/425
7,043,761 B2 * 5/2006 Epling ..... 2/7
7,870,618 B2 * 1/2011 Pilon ..... A42B 3/324 2/410
7,937,778 B1 * 5/2011 Norton ..... 2/414
2002/0159250 A1 * 10/2002 Kuo ..... A42B 3/044 362/106
2004/0107482 A1 * 6/2004 Picotte ..... A42B 1/08 2/411
2005/0257312 A1 * 11/2005 Puchalski ..... 2/411
2007/0107113 A1 * 5/2007 Mansfield, Jr. ..... A42B 1/006 2/411
2007/0157370 A1 * 7/2007 Joubert Des Ouches ..... A42B 3/32 2/410

(Continued)

*Primary Examiner* — Timothy K Trieu
(74) *Attorney, Agent, or Firm* — Brian Walter

(57) ABSTRACT

A device, system, and elements for providing customizable and regionalized head protection are disclosed. One or more protective elements and/or cushioning elements can be permanently or removably attached to a wearable shell, to provide an increased level of protection for a wearer. The size, shape, and composition of the one or more protective elements and/or cushioning elements can be varied to alter the level and location of protection provided by the head protection device. One or more accessories also can be included in the head protection device, such as light sources and reflectors to enhance the visibility of the head protection device and to provide illumination.

17 Claims, 12 Drawing Sheets

(56) References Cited

U.S. PATENT DOCUMENTS

| | | | | |
|---|---|---|---|---|
| 2008/0083053 | A1* | 4/2008 | Lin | A42B 1/08 2/422 |
| 2008/0198579 | A1* | 8/2008 | Crye et al. | 362/106 |
| 2013/0212784 | A1* | 8/2013 | Cleva | A42B 3/04 2/413 |

* cited by examiner

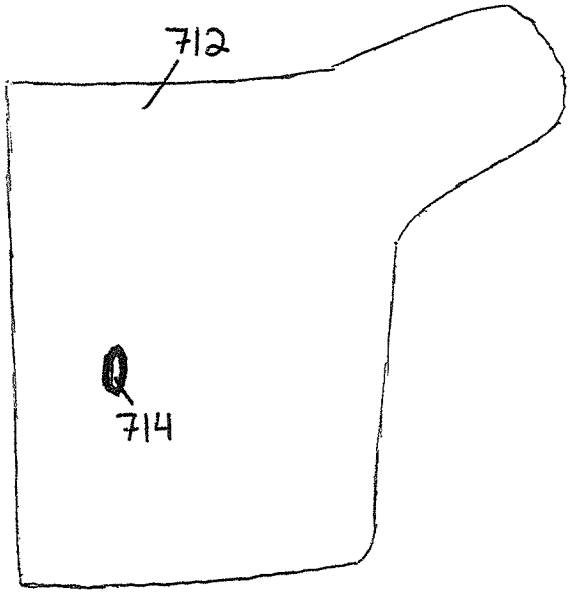
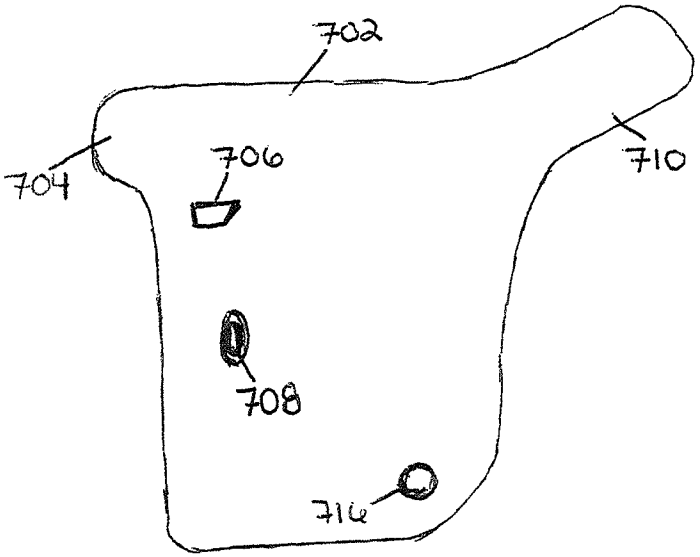
FIG. 7A

CUSTOMIZABLE HEAD PROTECTION

CROSS-REFERENCE TO RELATED APPLICATIONS

The present application is a U.S. non-provisional patent application of, and claims priority under 35 U.S.C. Sec. 119(e) to, U.S. provisional patent application No. 61/574,346, filed Aug. 1, 2011, titled "Adaptive Head Protection System", which is incorporated in its entirety herein by reference.

TECHNICAL FIELD

The present disclosure relates to the field of protective headgear, including headgear that provides regionalized and customizable protection.

BACKGROUND

As safety awareness has increased, the popularity of helmet use to reduce, if not eliminate, the risk and severity of injury due to a fall or impact also has increased. Helmet use has increased most significantly in cycling, skating, boarding and skiing sports. However, helmets are widely used in most contact sports, construction and industrial environments, motor sports, aviation, military operations, and emergency services.

Generally, protective helmets feature a rigid or semi-rigid external shell and a deformable shock-absorbing interior element. The external shell is typically constructed as a unitary piece, molded to roughly conform to the size and shape of at least a portion of a human head. Openings can be provided for ventilation and to enhance visibility and hearing. A helmet is generally designed to provide a level of protection suitable for the intended use, and helmets can thus vary significantly with respect to the type and amount of materials used.

Helmets with one or more articulating (also collapsible or folding) sections have been developed to reduce the amount of storage space required when the helmet is not in use. In articulating helmets, the exterior shell is seamed to form one or more flaps that can be folded relative to a main portion of the helmet, causing any underlying liner to fold as well. Through this arrangement, peripheral portions of the helmet can be folded into a central (or main) volume defined by the helmet, e.g., reducing the overall size by some amount. However, in order to fold a flap relative to the main portion of the helmet, a locking or securing mechanism typically must be released to permit the flap to move relative to the helmet.

Whether they are entirely rigid or include one or more folding peripheral sections, existing helmets provide a unitary, rigid portion that covers the top (or crown) of the head. The degree to which existing helmets provide protection for the sides, front, and back of the head varies primarily based on the intended use. For instance, cycling helmets typically do not cover much of the skull below the top of the ears while football helmets generally protect the entire skull. Nonetheless, the protection provided by each type of helmet generally cannot be modified beyond its original construction.

SUMMARY

The presenter inventors recognized the need for a head protection device that can be adapted to provide varying degrees of protection. The present inventors also recognized the need to permit either or both of the location and degree of protection provided by the head protection device to be customized. Further, the present inventors recognized the need to provide a head protection device that can be at least partially collapsed along at least one axis to reduce the amount of space required to store the head protection device when not in use.

The present inventors also appreciated the need to provide, in at least some instances, protective elements that can be affixed to and removed from the head protection device. For instance, a protective element can be added to the head protection device to provide increased protection in a region or can be removed from the head protection device to reduce the weight of the head protection device and increase its flexibility. Additionally, a protective element providing a greater degree of protection, e.g., through increased resistance to penetration and/or increased cushioning against impact, can be added to the head protection device to adapt the head protection device to a use requiring a higher degree of protection. The protective element providing a greater degree of protection can replace or augment a protective element providing a lower degree of protection, or can be applied to an area in which no protective element was located.

The present inventors also recognized that protective elements can be constructed of different materials to provide for differing levels of protection. For instance, the present inventors recognized that a protective element can be constructed of one or more layers, including one or more hardened layers adapted to protect against penetration. The present inventors also recognized that a cushioning element can be constructed of one or more cushioning layers adapted to protect against concussive forces (or impact). Additionally, the present inventors recognized that one or more protective elements and one or more cushioning elements can be integrated or otherwise attached to one another. The present inventors also recognized that two or more protective elements can be arranged on the head protection device such that they at least partially overlap.

Additionally, the present inventors recognized that the head protection device can include one or more functional elements. For instance, a functional element can include one or more of a light source, a mounting adapter, a sensor, a reflector, a battery, a speaker, communication electronics, a heating element, and a tool. A functional element can be integrated (either fixedly or separably) with a protective element or can be constructed as a separate element that can be coupled to the head protection device. Further, a functional element can be configured to mate with or at least partially overlap with one or more protective elements and/or one or more other functional elements.

The present inventors also recognized the need to permit connecting, temporarily or permanently, two or more protective elements and/or functional elements, e.g., to form a larger protection region. For instance, a temporal protective element and an occipital protective element can be joined using one or more intervening elements to form a larger, unitary protective region.

Accordingly, the areas of protection and the degree of protection offered in each area of a head protection device can be customized using one or more protective elements, e.g., to provide a desired protection configuration. Further, one or more functional elements can be added to the head protection device to provide desired functionality. Additionally, any or all of the protective elements and/or functional elements can be removed from the head protection device to provide for a reduced storage profile, e.g., by permitting the head protection device to be at least partially collapsed along at least one axis or in at least one region.

BRIEF DESCRIPTION OF THE DRAWINGS

Certain aspects of the present disclosure are set forth in the appended claims. However, for the purpose of explanation, several implementations of the present disclosure are set forth in the following figures and their corresponding descriptions. The implementations set forth are exemplary and should not be construed to limit the scope of the disclosure.

FIGS. 1*a-f* show an exemplary head protection device that includes at least one integrated protective element.

FIGS. 7*a* and 7*b* show an exemplary front protective element and corresponding front cushioning element.

An aspect or aspects described with respect to one figure can be adapted for use with an implementation set forth in another figure. In the figures, like reference numerals refer to like elements.

DETAILED DESCRIPTION

Figure 1A:
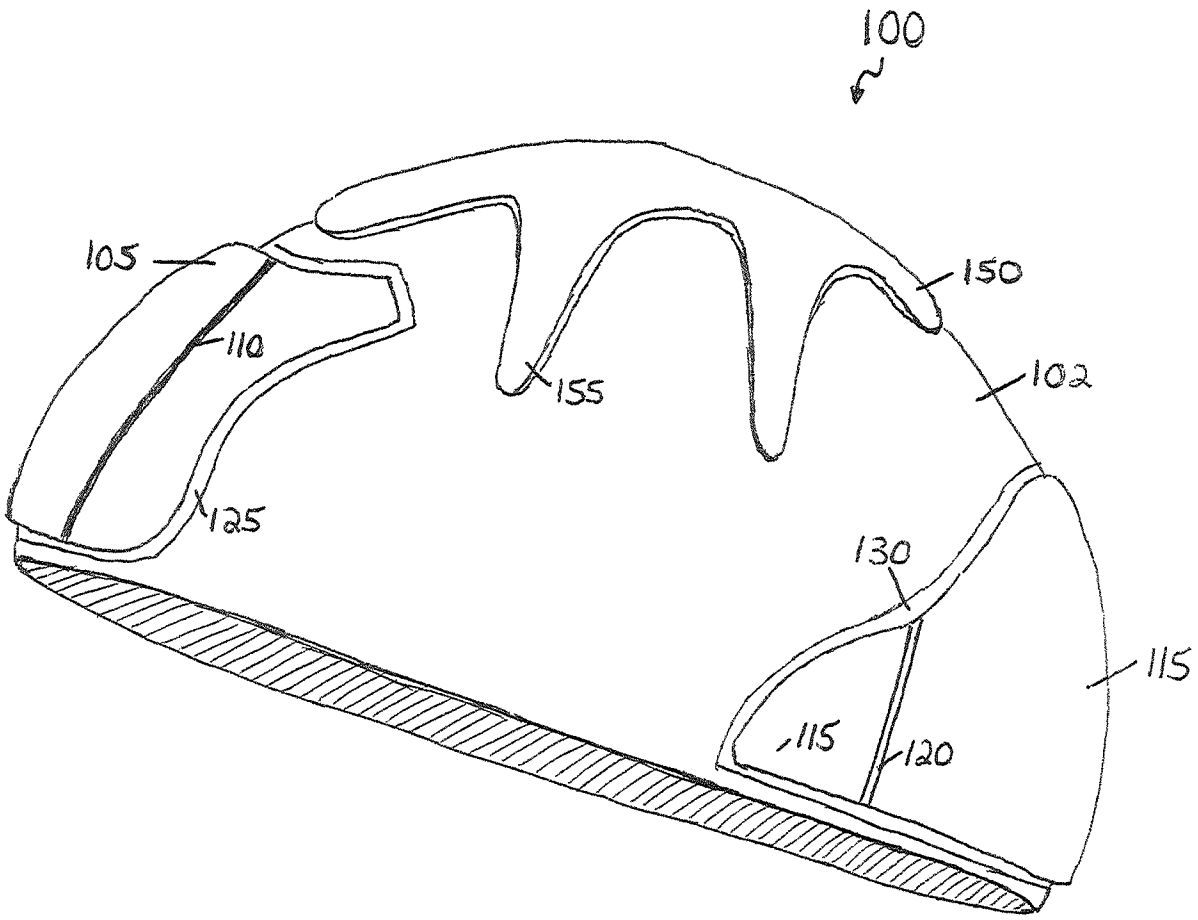

FIG. 1 shows an exemplary head protection device that includes at least one integrated protective element. The head protection device 100 can include a shell 102 constructed of any material or combination of materials, including one or more natural fibers such as cotton and wool, one or more artificial/synthetic fibers such as Rayon, Acetate, Nylon, Modacrylic, Olefin, Acrylic, Polyester, Carbon fiber, metal fiber, Lycra(R), Aramids (e.g., Kevlar, Nomex), polyolefin, or a blend of one or more natural fibers and one or more synthetic fibers. For example, in one instance, the shell 102 can be constructed of a cotton/Lycra® blend. The support element 105 also can be constructed from, at least in part, or can incorporate, material with a lesser degree or flexibility and/or inflexible material.

The shell 102 can be shaped to generally conform to a human skull, e.g., like a watch cap or knit ski cap. The material from which the shell 102 is constructed and the thickness of the shell 102 can be selected in accordance with the temperature range in which the head protection device 100 is intended to be worn. For instance, a warmer material or blend of materials can be used to construct a shell 102 intended to be worn in temperatures ranging from 0 to 32 degrees Fahrenheit than a shell 102 intended to be worn in temperatures ranging from 32 to 50 degrees Fahrenheit. Additionally, a wind and/or rain stopping material, e.g., Gore-Tex, can be included in the shell 102, either as one or more layers of the shell 102 or by being integrated into the shell 102.

Although the shell 102 can be tight-fitting and have a degree of elasticity, one or more elastic elements 104 can be included in the shell 102. The one or more elastic elements 104 can be configured to increase the degree to which the head protection device 100 adheres to the head and/or to cause one or more elements of the head protection device 100 to align with and remain in place over a corresponding portion of the head. For instance, an elastic band 104 can be included to increase the compression of the shell 102 to the head of a wearer and also to cause a front protective element 105 and a rear protective element 115 to remain in place, e.g., over at least a portion of the frontal and occipital regions of the skull, respectively. In other implementations, an elastic element 104 can be attached to or otherwise integrated with the shell 102 to provide increased elasticity over a particular region.

In some implementations, the shell 102 can be constructed as a single layer and one or more elements, including elastic elements and/or protective elements, can be attached to either or both of an inner portion and an outer portion of the shell 102. In some other implementations, the shell 102 can be constructed using two or more layers. In such implementations, one or more elements can be attached to either or both of an inner portion and an outer portion of the shell 102. Further, one or more elements, including elastic elements and/or protective elements, can be positioned between two layers of the shell 102. Additionally, in some implementations, the shell 102 can include one or more openings (or vias), e.g. through which a fastener for an element or accessory can be passed.

In some implementations, one or more elements of the head protection device 100 can be entirely enclosed within the shell 102. For instance, the exterior facing portions of front protective element 105 and rear protective element 115 can be entirely covered by an exterior layer of the shell 102. Further, the interior facing portions of front protective element 105 and rear protective element 115 can be entirely covered by an interior layer of the shell 102. As a result, the one or more enclosed elements can be sandwiched between at least two layers of the shell 102.

Additionally, in some implementations, a cushioning element can be associated with an element to provide additional protection. For instance, a front cushioning element 125 can be associated with front protective element 105 and a rear cushioning element 130 can be associated with rear protective element 115. In some implementations, a cushioning element can be permanently or separably attached to the corresponding element. For instance, the cushioning element can be attached to the corresponding element through any one or more of glue, thread, hook-and-clasp material, threaded connector(s), snap closure(s), heat-bonding, or any other mechanism known in the art. In other implementations, a cushioning element can be separate from the corresponding element, but they can be spatially associated. For instance, the cushioning element and the other element can be affixed to, seated in, or otherwise situated on a corresponding portion of the head protection device 100.

For example, front protective element 105 can be attached to front cushioning element 125 to form a composite protective element. A cushioning element, e.g., cushioning element 125, can be constructed of one or more compressible layers, each layer being constructed of one or more materials, such a compressible foam, gel, sponge, Styrofoam, polypropylene, polyethylene, polyurethane, paper, or other such impact dampening material. A compressible layer also can be a collapsible structure assembled from multiple materials. The material or materials used to fabricate a cushioning element can be resilient (substantially resumes its shape after being compressed) and/or non-resilient. For example, a cushioning element can include multiple layers of cushioning materials, e.g., having different densities.

Further, the cushioning element can include an enclosure, e.g. of an elastic material, to form a compressible package. The cushioning element is intended to absorb force to dampen or lessen the effect of that force on the head and brain.

A protective element, e.g., front protective element 105, can be constructed of one or more hardened layers, each layer being constructed of one or more hardened materials, such as plastic, carbon, wood, resin, composite material, Kevlar, metal, and other such materials. A hardened layer is intended to distribute force, e.g., such as the force generated during a collision with the ground, a body, or an object. A hardened layer also is intended to protect against penetration, e.g., from a sharp object or a projectile. In some instances, the hardened layer can be formed (e.g., cut, shaped, or molded) as a unitary piece. In such instances, the hardened layer can be inflexible or can flex as a unit. In some other instances, the hardened layer can be formed to include one or more seams or joints along which the hardened layer can bend. The seams or joints can be formed through manufacturing, e.g., by reducing the thickness of the hardened layer at one or more points. The seams or joints also can be formed by combining different materials, e.g., by using a more flexible material to join two or more pieces having less flexibility. In still other instances, a hardened layer can be constructed of two or more pieces that are at least partially overlapping, e.g., to permit flexing or bending to some degree, but to control the ability to bend or flex through the overlap. Additionally, a protective element, e.g., front protective element 105, can be formed to adapt to any shape, including the shape of all or a portion of the human head/skull. In one example, a protective element can be constructed of one or more hardened layers, shaped to conform to a portion, e.g., the forehead and temple region, of a human head. The protective element also can include layers of different materials. For instance, a metal inner layer can be at least partially covered by one or more plastic layers, to form a complex protective element.

A cushioning element and a corresponding protective element can be adapted to conform to a particular portion of the human head/skull. For example, a protective element, e.g., front protective element 105, can be designed to protect the forehead region of the human head. As such, the protective element can be shaped to fit the forehead region of a particular size or range of sizes, including with a generally flat region corresponding to the primary forehead area and curved or flexible regions corresponding to the temporal areas adjoining the forehead. Further, a cushioning element, e.g., front cushioning element 125, can be situated to correspond with the protective element. The cushioning element can be slightly larger than the protective element, e.g., to protect the head from the edges of the protective element. The cushioning element and the protective element can be joined through any means or combination of means, including glue, stitching, molding, bonding, and one or more mechanical fasteners. In some implementations, the cushioning element and the protective element can be permanently coupled to one another. In other implementations the cushioning element and protective element can be removably coupled, e.g., through reconnectable fasteners.

In other implementations, a protective element and a cushioning element can be separately attached to a corresponding region of the shell 102. For instance, one or more cushioning elements can be associated with an interior portion or intermediate portion or layer of the shell 102. Further, one or more protective elements, e.g., front protective element 105 and back protective element 115, can be associated with an intermediate or exterior portion or layer of the shell 102, such that one or more protective elements at least partially overlap with one or more cushioning elements. The one or more protective elements and one or more cushioning elements, however, can remain separate, so that they are not directly coupled to one another.

Figure 1B:
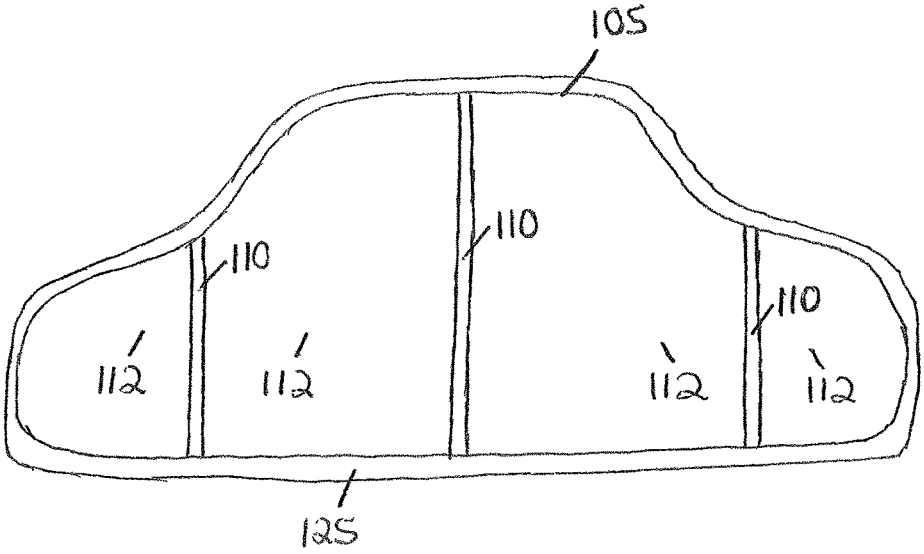

FIG. 1*b* shows an exemplary implementation of a front protective element, e.g., front protective element 105. Front protective element 105 can be manufactured from any hardened material or combination of materials and can be constructed, e.g., through molding or machining, to conform to any shape. For instance, front protective element 105 can be constructed to conform to the general shape of a region of a human head, e.g., the region of the human head the protective element is intended to cover when in use.

A protective element, such as front protective element 105, also can include one or more seams 110, which allow panels 112 (e.g., sections or portions) of the protective element to move relative to one another, such as to bend in order to conform to the head of a wearer. In some implementations, a protective element can be constructed as a unitary piece and one or more seams, e.g., seams 110 shown on front protective element 105, can be formed during manufacture. For example, a seam 110 can be formed by including less material in the area of the seam, e.g., during molding, or by taking some of the material used to construct the protective element away, e.g., through milling. In some other implementations, a protective element can be constructed of multiple pieces and the one or more seams 110 can be formed between two or more pieces. For instance, front protective element 105 can be constructed such that each hardened panel 112 is attached to a flexible member that allows the hardened panels 112 to move relative to one another, at least along a seam 110. In some such implementations, the flexible member can be a cushioning element, e.g., front cushioning element 125 associated with front protective element 105. The flexible member also can be a non-cushioning material or combination of materials, such as a flexible synthetic material, which can be used in conjunction with or in place of the cushioning element 125.

Figure 1C:
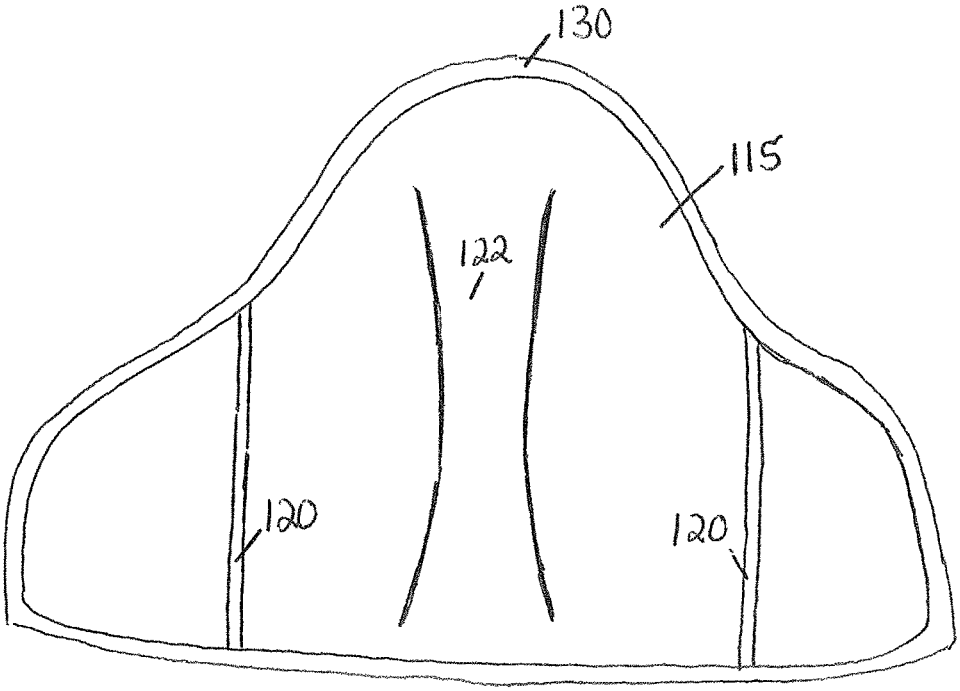

FIG. 1*c* shows an exemplary implementation of a rear protective element, e.g., rear protective element 115. Rear protective element 115 can include seams 120, which allow plates of the rear protective element 115 to move relative to one another. Rear protective element 115 also can correspond to a cushioning element, e.g., rear cushioning element 130. Rear cushioning element 130 can extend beyond the boundary of rear protective element 115 at one or more locations, e.g., to protect a wearer from an edge of the rear protective element 115. Additionally, one or more surfaces of a protective element can include one or more raised or recessed areas. For instance, rear protective element 115 can include a channel 122, which can be formed by creating one or more raised areas and/or one or more depressed areas in rear protective element 115. The channel 122 can serve numerous functions, including to increase the protection against impact offered by the rear protective element 115, to increase the strength of rear protective element 115, and/or to reduce the weight of rear protective element 115.

Figure 1E:
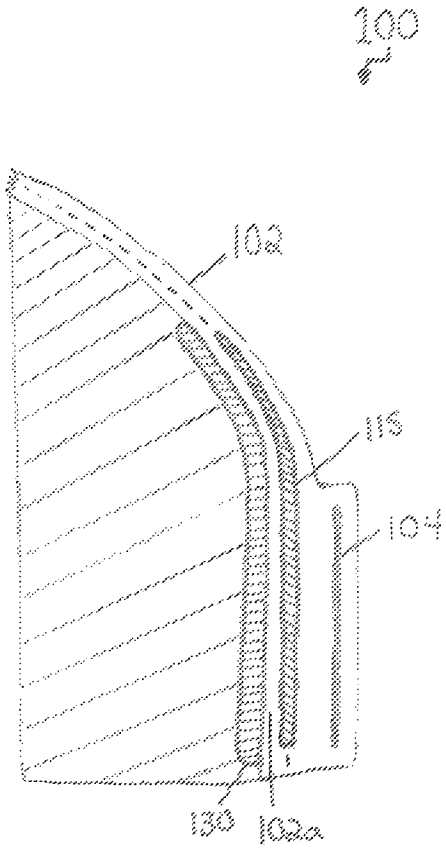
Figure 1D:
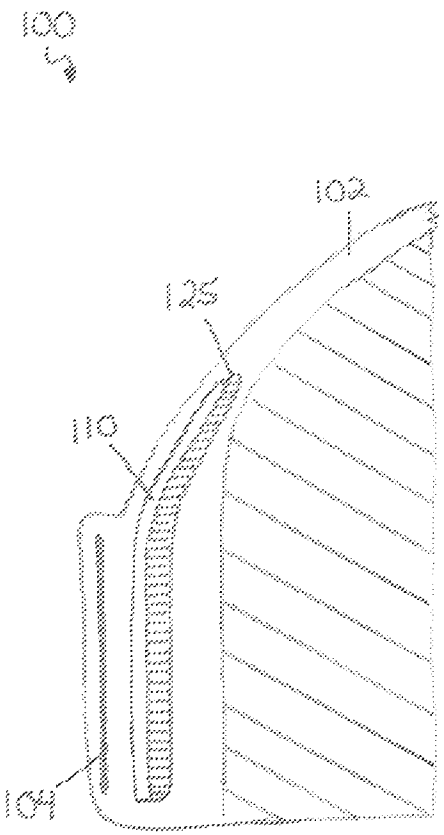
Figure 14:
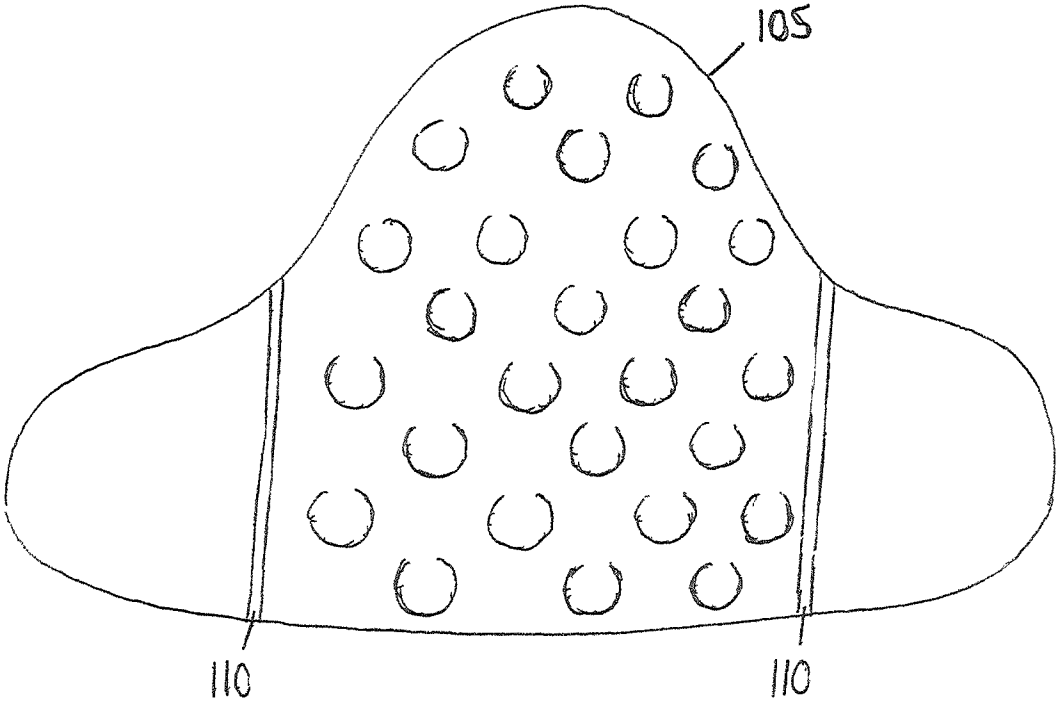

FIG. 1*d* shows a cross-section of an exemplary implementation of a head protection device, e.g., the head protection device 100. In the exemplary implementation, the front protective element 105 is shown immediately adjacent to the front cushioning element 125. The front protective element 105 and the front cushioning element 125 are enclosed within the shell 102, which can be constructed from any number of layers. As a result, the front protective element 105 and the front cushioning element 125 are not directly visible from the outside or the inside of the head protection device 100.

FIG. 1*e* shows another cross-section of an exemplary implementation of a head protection device, e.g., the head protection device 100. In this implementation, the rear protective element 115 is shown enclosed within the shell 102, which can be constructed from any number of layers. However, the rear cushioning element 130 is shown outside of the shell 102, so that at least one layer of the shell 102, e.g., layer 102*a* , is situated between the rear protective element 115 and the rear cushioning element 130. As a result, the rear cushioning element 130 is directly visible from the inside of the head protection device 100. In some other implementations, one or more additional elements can be included in the head protection device 100, inside of the shell 102, outside of the shell 102, and/or in between layers of the shell 102. The one or more additional elements can be protective elements, cushioning elements, and/or functional elements.

FIG. 1*f* shows an exemplary protective element on the exterior of a head protection device, e.g., the head protection device 100. The protective element, e.g., front protective element 105, can be attached to or otherwise integrated with the shell 102 through any means. In some implementations, a cushioning element can be integrated with the protective element. In some other implementations, a cushioning element can be positioned on the head protection device such that it is at least partially aligned and at least partially overlapping with the protective element, but can be separated from the protective element by one or more intervening elements, such as the shell 102. In still other implementations, the head protection device 100 can be constructed without any other elements corresponding to the protective element, e.g., protective element 105.

Additionally, a protective element, e.g., front protective element 105, can include one or more surface features. For instance, a protective element can include any of bumps, ridges, dimples, fins, cross-hatching, and raised irregular patterns, or any combination thereof. The surface features can cover any portion of the surface of a protective element and the surface features can be separated from one another by any distance and can occur at any interval.

As shown in FIG. 1, by associating one or more protective elements, cushioning elements, and/or functional elements with one or more locations on the shell 102, one or more other locations on the shell 102 can remain free of any elements and thereby can be folded or collapsed, such that the head protection device 100 can occupy a smaller space than when it is worn. In other implementations, the head protection device 100 can be substantially completely covered, on one or more surfaces, with protective elements, cushioning elements, and/or functional elements. However, the elements can be arranged such that one or more hinges, seams, and/or joints exist on and/or between the elements, permitting at least a portion of the head protection device 100 to be folded or collapsed. Accordingly, the head protection device 100 can be packed into and stored in a smaller space than if it were entirely hardened without any flexible portions, seams, joints, or hinges.

A center protective element 150 also can be included in the head protection device 100 and can be situated such that it extends along all or a portion of the centerline of the head protection device 100. The center protective element 150 can include an integrated cushioning element, be associated with a separate cushioning element, or have no associated cushioning element. In some implementations, the center protective element 150 can be coupled, detachably or permanently, to either or both of the front protective element 105 and the rear protective element 130. In some other implementations, the center protective element 150 can be separate from any or all other elements included in the head protection device 100.

The center protective element 150 also can include one or more spines 155 (or fingers) projecting outward along the contour of the head protection device 100, e.g. along at least a portion of either or both sides. In some implementations, a spine can be substantially inflexible and can conform to the contour of the head protection device 100 when it is in use. In some other implementations, a spine can be substantially flexible and can thus conform to the shape of the shell 102 whether it is in use or folded for storage. Additionally, in some implementations, a spine can be constructed solely as a cushioning element.

The center protective element 150 also can be hinged, to assist with folding or collapsing the head protection device 100 at least partially when it is not in use. The hinged center protective element further can include one or more securing or locking elements to prevent the center protective element 150 from folding or collapsing when the one or more securing or locking elements are engaged. In other implementations, the center protective element 150 can be constructed using two or more elements, e.g., protective elements, that can move relative to one another. Further, in some implementations, the two or more elements used to construct the center protective element 150 can be arranged to partially overlap.

Additionally, in the head protection device 100, a protective element, e.g., front protective element 105, can include one or more anchor points (or attachment points) to which one or more devices can be secured, including other protective elements, functional elements, and accessories. For example, one or more cameras, light sources, speakers, sensors, and communication devices can be mounted to an anchor point. By way of another example, in some implementations, one or more protective panels can be attached to the center protective element, e.g., through the use of anchor points and joints. A protective panel can be formed to correspond to the anatomical shape of the skull. When engaged, the center protective element and one or more protective panels can function to form a protective region around at least a portion of the skull, e.g., as would a molded helmet. Thus, the hardened protective region or regions of the head protection device 100 can be configured to provide full coverage, i.e., similar to that of a molded helmet, or partial coverage. Further, in some implementations, the head protection device 100 can include one or more additional securing mechanisms, e.g., a chin strap, to secure the device to a wearer.

Figure 2:
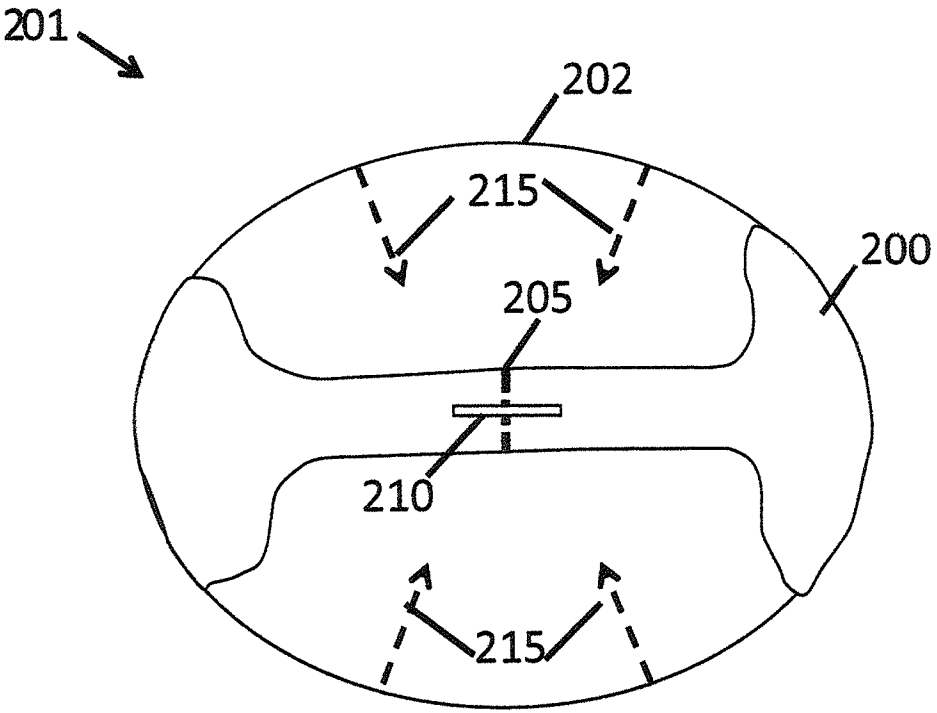
FIGS. 2 and 3 show top views of exemplary head protection devices.

FIG. 2 shows a top view of an exemplary head protection device. The head protection device 201 can include a protective element 200, which can be configured to provide protection for multiple regions of a head, including the forehead, top of the head, and back of the head. The protective element 200 can include an integrated cushioning element. Alternatively, in some implementations, one or more separate cushioning elements can be included in one or more locations that at least partially overlap with the protective element 200. In some implementations, the protective element 200 and any associated cushioning elements and/or functional elements can be permanently integrated with or otherwise attached to the head protection device 201. In other implementations, any of the protective element 200 and any associated cushioning elements and/or functional elements can be removably attached to the head protection device 201.

The protective element 200 further can be configured to have one or more hinges or joints, e.g., joint 205, at which the protective element 200 can be moved. For example, the joint 205 can permit the forward portion of the protective element 200 to be bent toward the rear portion of the protective element 200. The shell 202 also can be flexible, e.g., in the direction arrows 215. Thus, the head protection device 201 can be at least partially collapsed when not in use, at least front to back, to permit storage in a smaller area than when the protective element 200 is fully deployed (or extended). In implementations where the sides also are flexible (or moveable), e.g., in the direction of arrows 215, the head protection device 201 can be folded such that it occupies a substantially reduced area as compared to when it is fully deployed.

In some implementations, the protective element 200 also can include one or more securing mechanisms, e.g., latch 210, which can be engaged when protective element 200 is fully extended to lock protective element 200 into an open position and prevent it from closing. The one or more protective elements further can be disengaged to permit the protective element 200, and in turn the head protection device 201, to be at least partially collapsed.

Figure 3:
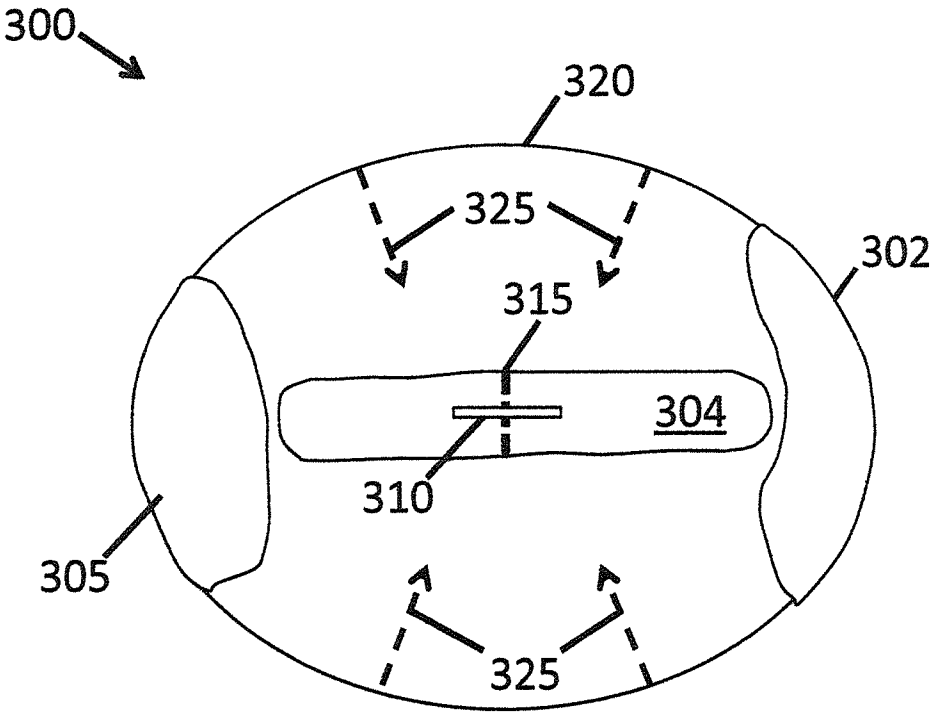

FIG. 3 shows a top view of an exemplary head protection device 300. The head protection device 300 can include multiple elements, e.g., elements 302, 304, and 305. Each of the protective elements associated with the head protection device 300 can be any of a protective element, a cushioning element, a functional element, or a combination element that has two or more of protective, cushioning, and functional aspects. Also, a cushioning element can be positioned beneath a protective element, e.g., element 305 in the head protection device 300, such that the cushioning element overlaps at least partially with the protective element. Further, one or more of the elements, e.g., elements 302, 304, and 305, of the head protection device 300 can be removable. For instance, element 302 can be a protective element constructed of two or more pieces and further can include one or more securing elements that can extend through the shell 320, such that the pieces comprising the protective element can be coupled and/or uncoupled through the shell 320. In other implementations, an element can be removably coupled to the head protection device 300 through any other means, including, e.g., one or more of hook-and-tab fasteners, snaps, buttons, clips, pins, zippers, etc. In some implementations, one or more alignment guides can be provided, e.g., on the shell 320, to ensure a removable element is properly located on the head protection device 300.

Further, center element 304 can be removable and also can include one or more hinges or joints, e.g., joint 315, and one or more securing mechanisms, e.g., latch 310. Thus, the head protection device 300 can be collapsed either by disengaging latch 310 and moving the center element 304 with respect to joint 315, or by removing the center element 304 from the shell 320. Further, the head protection device 300 can be collapsed with respect to one or more joints or hinges, or in a non-hardened area of the support element, e.g., in the direction of arrows 325.

Figure 4C:
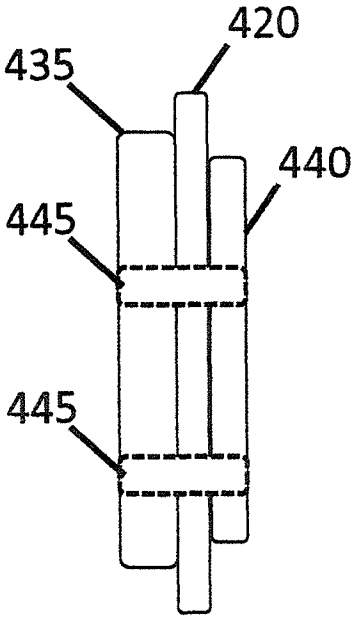
FIGS. 4*a-c* show exemplary elements associated with a head protection device.
Figure 4B:
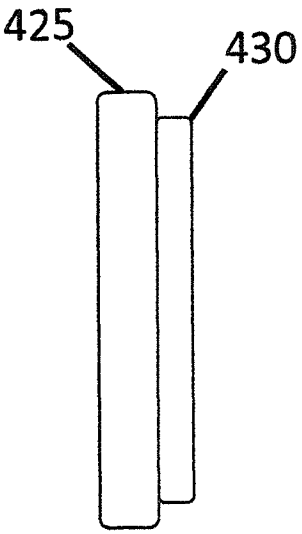
Figure 4A:
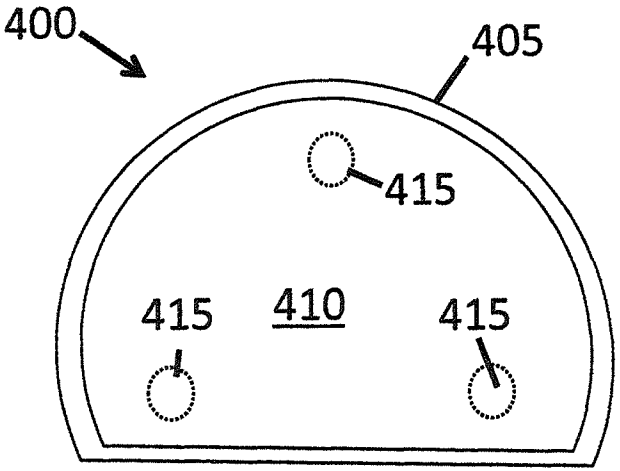

FIGS. 4*a-c* show exemplary elements associated with a head protection device. FIG. 4*a* shows a combination element 400 that includes both a cushioning element 405 and a protective element 410. The cushioning element 405 is larger than the protective element 410, such that the cushioning element 405 extends beyond the perimeter of the protective element 410 at all points. As a result, the head of a wearer can be protected against direct contact by an edge or portion of an edge of the protective element 410, e.g., during an impact to the element 400. In other implementations, the cushioning element 405 can be the same size or smaller than the protective element 410. Additionally, in some implementations, the cushioning element 405 and the protective element 410 can be joined to one another either permanently or temporarily (such that the elements can be separated from and reattached to each other). In some other implementations, the cushioning element 405 and the protective element 410 can be separate elements, which can be couple to one another either directly or indirectly, e.g., through coupling both elements to a shell.

The cushioning element 405 can be a simple element, made up of one layer and one material, or a complex element, made up of multiple materials and/or multiple layers. Any cushioning material (i.e., a material that can be compressed to absorb some degree of force) or materials can be used to construct the cushioning element 405. Further, any arrangement of the material or materials can be used to construct the cushioning element. In some implementations, one or more non-cushioning materials and/or non-cushioning layers can be used in conjunction with one or more cushioning materials to construct a cushioning element. For instance, one or more layers of a cloth, e.g., cotton or Lycra®, can be used to package a cushioning element. In implementations in which a gel or fluid, e.g., water or air, is used in the cushioning element 405, one or more layers of insulating material can be used to seal the cushioning element to prevent the gel or fluid from escaping.

In the element 400, the cushioning element 405 can provide complete coverage of one side of the corresponding protective element 410. In some other implementations, the cushioning element can cover only a portion of the hardened element, e.g., the outer edge or a number of points.

The element 400 also can include one or more vias 415 (or holes) extending through, either completely or partially, either or both of the cushioning element 405 and the protective element 410. The vias 415 can be used to secure the cushioning element 405 to the protective element 410, either directly or with one or more intervening structures, such as a shell of a head protection device. For example, a removable or non-removable securing mechanism can be inserted through a via to secure two or more elements and any intervening layers (e.g., the shell) and/or structures. For example, one or more securing posts can be integrated with a cushioning element, e.g., using a hardened backing to prevent them from transferring force to a wearer. The one or more securing posts can extend toward, contact, or pass at least partially through openings in the corresponding protective element, passing through any intervening structures, such as a shell and/or one or more other elements. Further, a locking cap, such as a nut, can be attached to a securing post to fasten the protective element to the corresponding cushioning element. In some implementations, the locking cap can be flush with or recessed below an exterior portion of the protective element, such that the force of an impact is not applied directly to the locking cap and/or securing post.

FIG. 4*b* shows a side view of a combination element, which includes a cushioning element 425 and a protective element 430. The cushioning element 425 and the protective element 430 can be fixedly or removably coupled to one another. For instance, the cushioning element 425 and protective element 430 can be bonded, sewn, glued, screwed, clipped, clamped, clasped, or otherwise attached to one another. Each of the cushioning element 425 and the protective element 430 can be a simple element or a complex element. For instance, the protective element 430 can be made up of a single layer and a single material, such as a wood, metal, plastic, or composite material. Alternatively, the protective element 430 can be made up of multiple layers and/or materials. For example, the protective element 430 can have an inner layer made of one material, e.g., metal, and an outer layer made up of a second material, e.g., a composite. Any combination of simple and/or complex elements can be used. Further, in other implementations, a head protection device can include one or more other layers or elements on either or both sides of a protective element, or between the cushioning element 425 and the protective element 430, such as a shell, an elastic element, or a functional element.

FIG. 4*c* shows an intervening object 420 situated between a cushioning element 435 and a protective element 440. The intervening object can be a single item, such as a shell, an accessory, or another element. Alternatively, the intervening object can be multiple items, including any combination of a shell, one or more elements, and one or more accessories. In some implementations, either or both of the cushioning element 435 and the protective element 440 can be replaced by a different type of element. For example, the protective element 440 can be replaced with a cushioning element or a functional element. One or more vias 445 can be included in the cushioning element 435 and the protective element 440, as well as in the intervening object 420, to permit the elements to be fastened to one another and to the intervening object 420. In some implementations, one or more vias 445 also can be included for ventilation.

Figure 5:
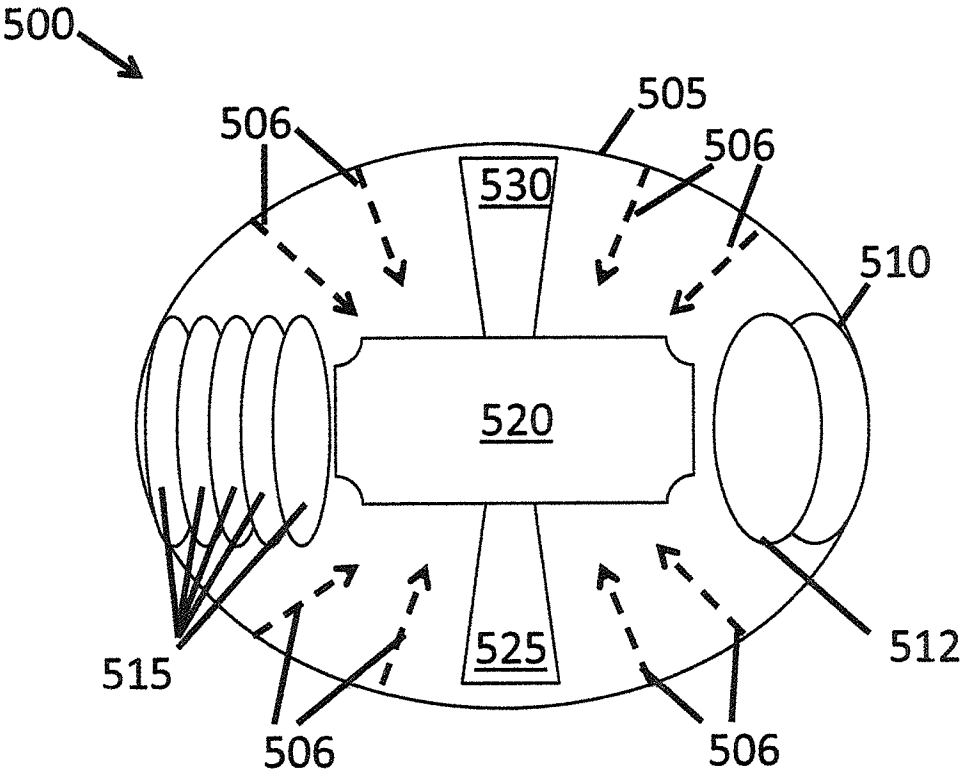
FIG. 5 shows an exemplary head protection device that includes overlapping protective elements.

FIG. 5 shows an exemplary head protection device 500 that includes overlapping protective elements. The head protection device 500 can include a shell 505, e.g., of a flexible cloth or knit blend, to which multiple protective elements, cushioning elements, functional elements, and/or accessories can be attached. Each of the elements and/or accessories can be permanently or removably attached. For example, a pair of front protective elements 510 and 512 can be permanently attached to the shell 505 at one or more locations. The front protective elements 510 and 512 can be arranged such that they are at least partially overlapping. Further, each of the front protective elements 510 and 512 can be only partially attached to the shell 505 in order to permit them to move with at least one degree of freedom. Thus, front protective elements 510 and 512 do not prevent the shell 505 from being folded, e.g., so that it can be stored in a relatively smaller space than the head protection device occupies when fully deployed. For example, the shell 505 can be moved, bent, or collapsed along one or more of the directions indicated by arrows 506. Additionally, one or more cushioning elements also can be attached to the shell 505 in one or more locations at least partially overlapping with the front protective elements 510 and 512.

The head protection device 500 also can include an array of rear protective elements 515. The rear protective elements 515 can be arranged such that each is at least partially overlapping within at least one other of the protective rear protective elements 515. The rear protective elements 515 also can be partially free from attachment to the head protection device 500, such that they are able to move with respect to at least one degree of freedom. The rear protective elements 515 further can be arranged such that they constrain the degree to which overlapping rear protective elements 515 can move, e.g., when the head protection device 500 is being worn. Thus, the rear protective elements 515 can form a flexible but hardened protective region. Additionally, one or more cushioning elements also can be attached to the shell 505 in one or more locations at least partially overlapping with the rear protective elements 515.

Additionally, a center protective element 520 can be included on the head protection device 500. In some implementations, the center protective element 520 can be associated with a cushioning element but can be separate from other protective elements. In some other implementations, the center protective element 520 can be associated with a cushioning element and can partially overlap with one or more other protective elements, such as lateral protective elements 525 and 530, to form another flexible but hardened protective region. The overlap between the center protective element 520 and either or both of lateral protective elements 525 and 530 can act as a hinge that allows for a limited degree of travel. For example, an edge of a lateral protective element can be positioned under the center protective element 520, such that when the head protection device 500 is not being worn, the lateral protective element can be moved inward to permit the head protection device 500 to be at least partially flattened or collapsed. When the head protection device 500 is being worn, however, the lateral protective element, e.g., element 525, can be prevented from moving inward by the wearer's head and can be prevented from moving upward beyond a certain distance by the overlap with center protective element 520 and/or an attachment to the shell 505. Thus, the head protection device 500 can form a substantially rigid protective system, at least in some areas, while in use and nonetheless can be at least partially collapsible when not in use.

Figure 6:
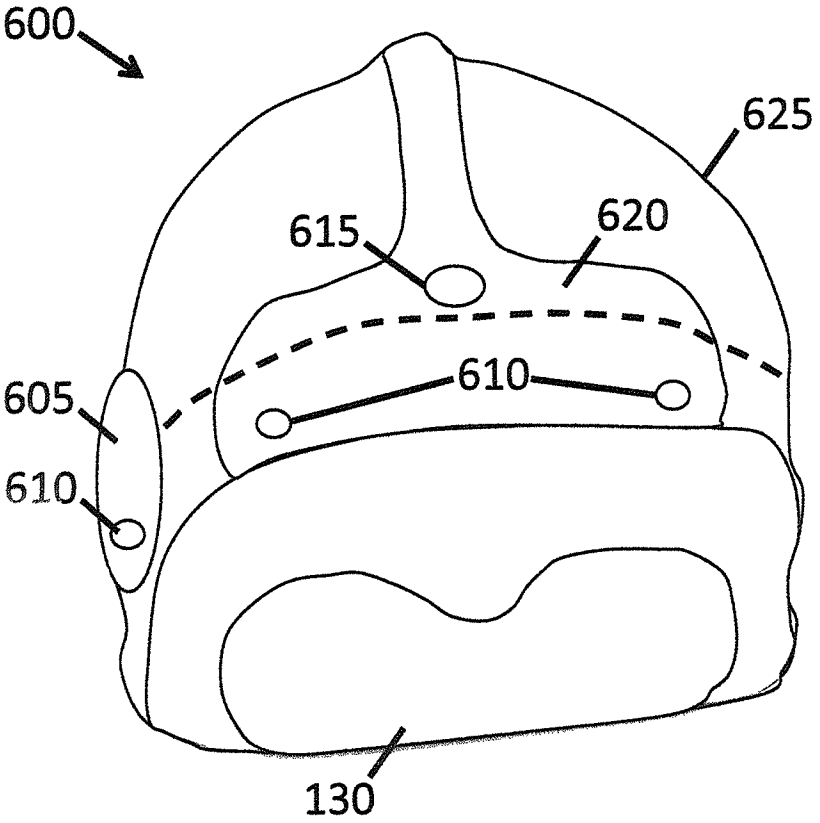
FIG. 6 shows an exemplary head protection device that includes one or more elements featuring an integrated accessory and/or an integrated accessory mount.

FIG. 6 shows an exemplary head protection device 600 that includes one or more elements featuring an integrated accessory and/or an integrated accessory mount. Any type of element can include an integrated accessory or accessory mount, e.g., protective elements, cushioning elements, and functional elements. For instance, a lateral protective element 605 can include one or more accessory mounts, such as accessory mount 610, e.g., for a camera, headset, chin strap, visor, shield, mask, or light. Some accessories can be mounted using a single mount, while other accessories can be mounted using two or more mounts. In some implementations, the accessory mount 610 can be specially adapted to a particular type of device, e.g., a camera. In some other implementations, the accessory mount 610 can be a universal mount adapted to receive all devices or all devices of a type/class or set of types/classes. Further, in some implementations, the accessory mount 610 can be adapted to provide power to an accessory when mounted. For instance, the lateral protective element 605 can be configured to house one or more power sources, such as one or more rechargeable or non-rechargeable batteries, super capacitors, and photovoltaic cells.

Further, front protective element 620 can include an integrated accessory 615, such as a headlamp. (As noted above, any accessory, including a lamp or other light source, also can be included in any other element.) For instance, headlamp 615 can include one or more LED light sources, a power supply, and an on/off switch. The headlamp 615 can be switched on to illuminate an area in the vicinity of the head protection device 600 and to increase visibility to others. Further, the headlamp 615 can include light sources that can be focused at one or more locations, e.g., in front of or to the side of the front protective element 620, and one or more distances. An integrated accessory can be any active or passive accessory. For instance, a protective element on the rear portion of the head protection device 600 can include one or more light sources and/or reflectors to increase visibility. The light sources and reflectors can be any color or combination of colors, such as red, white, blue, green, purple, and yellow. Further, the light sources can be programmable, e.g., to turn on and off in accordance with a pattern, e.g., to make the wearer visually identifiable to others. One or more sensors also can be integrated into a protective element, including one or more photo sensors, gyroscopes, accelerometers, temperature sensors, etc., to provide for specific functionality. For instance, one or more photo sensors can be used to automatically control one or more light sources included in the head protection device 600. Further, output from the one or more gyroscopes and/or accelerometers can be used to set off an alert, e.g., broadcast through an integrated speaker, when the wearer is believed to have suffered a significant trauma or impact.

An element also can include one or more integrated microphones and/or speakers, which can be adapted to communicate with an external device, such as a phone or media player, via a wired or wireless interface. The integrated accessory or accessories requiring electricity can be powered through one or more removable batteries, e.g., housed in a battery compartment located in the same element or another portion of the head protection device 600. Alternatively, the integrated accessory or accessories requiring electricity can be powered through a battery embedded within an element or other structure of the head protection device 600. For example, a thin form factor lithium ion battery can be integrated within an element, e.g., front protective element 620 along with the wiring and/or circuitry required for powering one or more accessories and for wired and/or wireless charging.

In some implementations, an integrated accessory can be inserted into and removed from an element, e.g., to permit replacement and/or upgrade. Further, an element can include circuitry to permit an accessory to be controlled/programmed and to permit sensor data to be read, wired or wirelessly.

In some implementations, the head protection device 600 can be implemented such that the shell 625 includes one or more pockets, each adapted to receive a protective element, a cushioning element, or a combination element. For example, a pocket can be formed in the material of the shell 625. The opening of the pocket further can be formed using overlapping pieces of flexible material, e.g., the same material from which the shell 625 is constructed. The element can be inserted into and removed from the pocket by stretching the overlapping pieces to form an opening through which the element can be passed. A pocket can be located on the inner or outer portion of the shell 625. One or more pockets can be used in conjunction with other element arrangements, including removable elements and/or permanently affixed elements, to form the head protection device 600.

Additionally, in some implementations, one or more protective elements can be inserted between two layers of the shell 625 to provide a protective region. The one or more protective elements can be at least partially flexible, e.g., implemented using a sheet of plastic or composite material. Alternatively, an array of protective elements can be arranged adjacent to one another, e.g. in one or more pockets, taped together, or otherwise held in a substantially fixed position, to form a flexible protective region. A protective element also can include one or more surface features, such as bumps, ridges, or other such raised regions. Further, the one or more protective elements can be configured to conform or adapt to an anatomical region or regions of the human skull, e.g., corresponding to the position of the head that the hardened elements will cover.

Figure 7B:
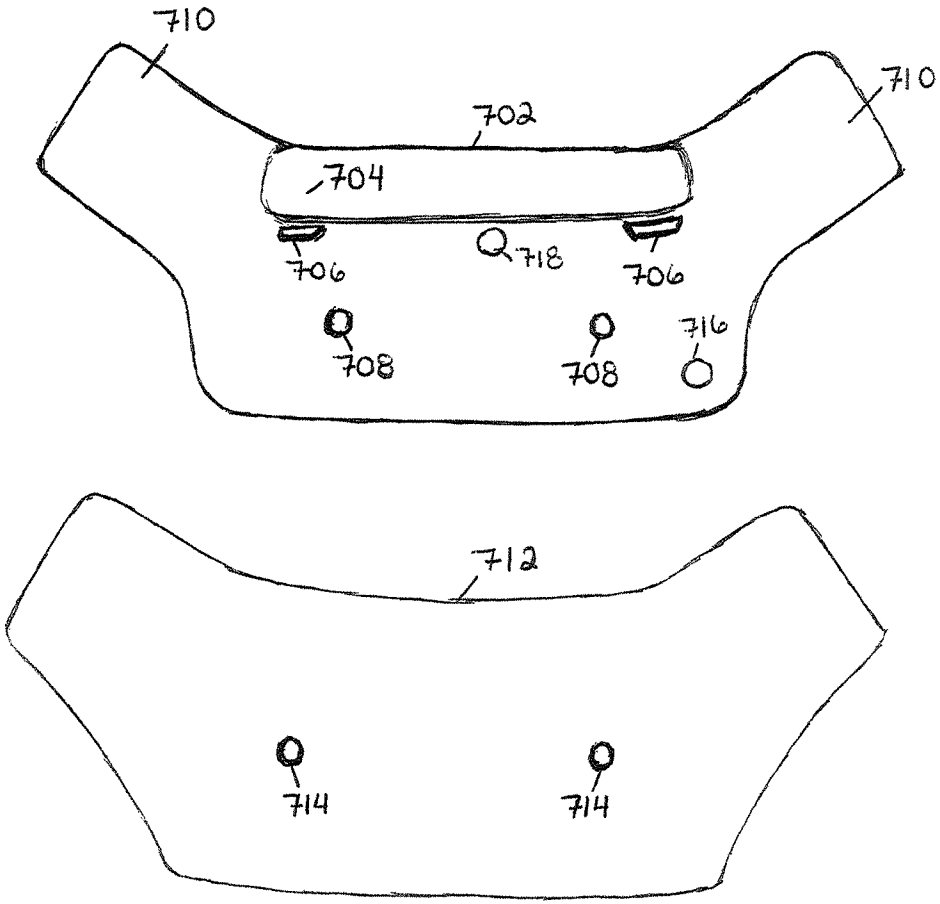

FIGS. 7*a* and 7*b* show side and front views an exemplary front protective element 702 and a corresponding front cushioning element 712, respectively. Front protective element 702 and front cushioning element 712 can be used in conjunction with any headwear, including, e.g., a custom flexible shell adapted for use with one or more elements and general purpose headwear, such as a knit ski cap or toboggan.

Front protective element 702 can be constructed of a rigid or semi-rigid material or combination of materials, such as any one or more of metal, wood, carbon fiber, plastic, rubber, Kevlar, or other such natural and/or synthetic materials. Front protective element 702 can be sized and shaped to generally conform to one or more regions of a human head. For instance, front protective element 702 can be sized and shaped to generally conform to at least part of the frontal and temporal regions of an average adult male head. In other implementations, an element, e.g., front protective element 702, can be adapted to conform to other regions, sizes and/or shapes, such as a child's head. In some implementations, an element, e.g., front protective element 702, can provide full coverage for one or more regions of the head. In other implementations, an element, e.g., front protective element 702, can provide partial coverage for one or more regions.

The degree (or level) of protection provided by front protective element 702 can be varied by the size, shape, thickness, material or materials, construction, and manufacturing used to create front protective element 702. Similarly, the degree of protection provided by front cushioning element 712 can be varied by the size, shape, thickness, material or materials, construction, and manufacturing used to create front cushioning element 712. Additionally, the degree of protection provided by a combination of elements, e.g., front protective element 702 and front cushioning element 712 can be varied in accordance with the properties of each individual element. As a result, the protection provided by a head protection device can be customized by the selection and placement of the included elements.

Front protective element 702 can include one or more surface features, e.g., ridge 704. A surface feature or combination of surface features can be used for a variety of purposes, including to provide increased protection in a particular region, to accommodate a functional element or accessory, to increase the strength of the element, to reduce the weight of the element, and to reduce the materials used to construct the element.

Front protective element 702 also can include one or more light sources 706, such as light-emitting diodes. In some implementations, the one or more light sources 706 can be focused on one or more distances in front of the element. The one or more light sources 706 can be of a single color or of multiple colors, which can be used selectively or in combination. An activation switch 716 can be included to permit turning the one or more light sources 706 on and off. Further, a photosensor 718 can be included to permit automatically turning the one or more light sources 706 on and off. In some implementations, the one or more light sources 706 also can be configured to illuminate in a particular sequence, e.g., by selecting a preprogrammed sequence or programming a custom sequence. An element, e.g., front protective element 702, can also include a power source. In some instances, the front protective element 702 can include an embedded power source, such as one or more rechargeable and/or replaceable batteries. In some other instances, the front protective element 702 can include one or more photovoltaic cells, an inductive coil, or other such power collection device and a rechargeable power supply, such as a super capacitor or battery.

Additionally, front protective element 702 can include one or more vias 708, through which a fastener can be inserted to secure the front protective element 702 to a shell and/or one or more other elements. For instance, fasteners can be inserted through the vias 708 to attach the front protective element 702 to the front cushioning element 712, e.g., through the vias 714 or to fasteners inserted through the vias 714. The fasteners also can pass through or couple to any intervening layer or element, such as a shell. The fasteners can be permanent or releasable, to permit removal and reattachment.

Front cushioning element 712 can be constructed of an at least partially compressible and/or at least partially flexible material or combination of materials, such as any natural or synthetic fiber or combination of natural and synthetic fibers, and/or any natural, synthetic, or combination foam. The material or materials used to construct front cushioning element 712 can be porous or non-porous. Front cushioning element 712 also can include any fluid, e.g., water or air, and/or any gel. Front cushioning element 712 can be sized and shaped to generally conform to one or more regions of a human head. For instance, front cushioning element 712 can be sized and shaped to generally conform to at least part of the frontal and temporal regions of an average adult male head. Further, front cushioning element 712 can be sized and shaped to correspond to front protective element 702. For example, front cushioning element 712 can be slightly larger, such that it overlaps front protective element 702 at some or all points along its periphery. In some other implementations, front cushioning element 712 can be made up of numerous smaller cushioning elements, which can correspond to particular locations on front protective element 702, such as one or more locations in the center and along the periphery of front protective element 702.

In other implementations, an element, e.g., front cushioning element 712, can be adapted to conform to other regions, sizes and/or shapes, such as a child's head. In some implementations, an element, e.g., front cushioning element 712, can provide full coverage for one or more regions of the head. In other implementations, an element, e.g., front cushioning element 702, can provide partial coverage for one or more regions.

Additionally, in some implementations, front cushioning element 712 can be used in a head protection device without a corresponding protective element, e.g., front protective element 702. In such implementations, front cushioning element 712 can be attached to the interior or exterior of a head protection device, or placed in between layers of a shell of the head protection device.

Figure 8A:
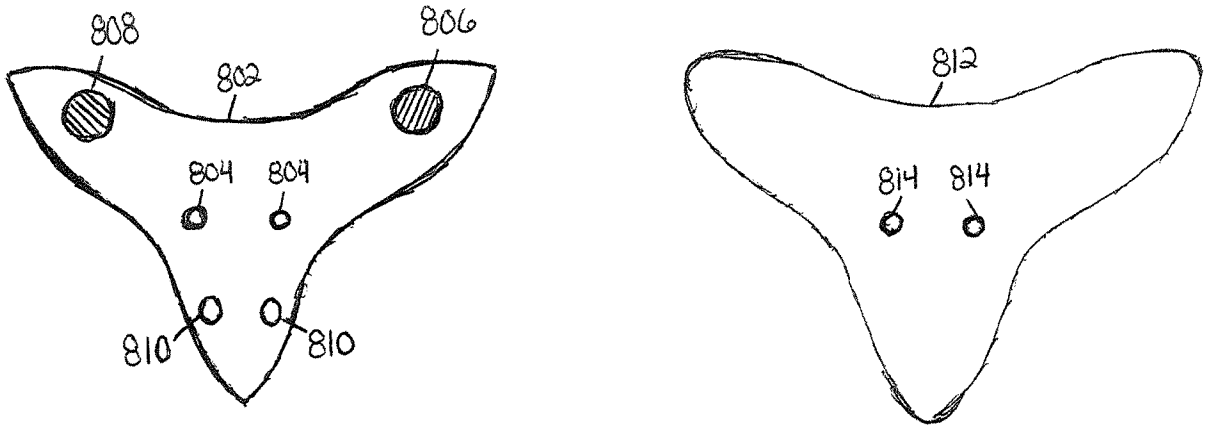
FIGS. 8*a* and 8*b* show an exemplary back protective element and corresponding back cushioning element.
Figure 8B:
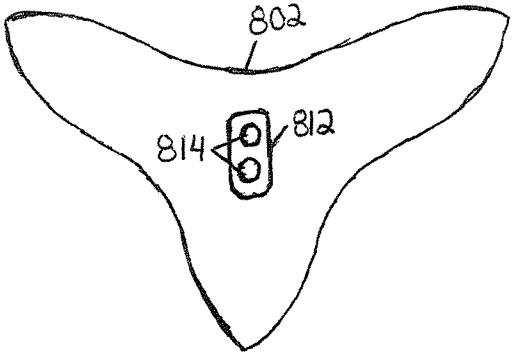

FIGS. 8*a* and 8*b* show an exemplary rear protective element and corresponding rear cushioning element. The rear protective element 802 can include one or more vias 804 through which one or more fasteners can be inserted to attached the rear protective element 804 to the shell of a head protection device and/or another element, such as rear cushioning element 812. Rear cushioning element 812 also can include one or more vias 814 for attaching it to a shell or another element. In some implementations, the one or more vias can be omitted and rear protective element 802 and rear cushioning element 812 can be attached to each other and/or a shell through other means, such as bonding, hook-and-loop fasteners, sewing, glue, etc. In some other implementations, one or more additional vias 804 and 814 can be included to facilitate the attachment of an accessory, an accessory mount, or a functional element. For instance, a camera mount can be removably secured to front protective element 802 through one or more vias 804.

In some implementations, the rear protective element 802 can be a combination protective and functional element. For example, rear protective element 802 can include one or more reflectors, e.g., reflectors 806 and 808, to increase visibility. In some implementations, the reflectors 806 and 808 can have different shapes, colors, or reflective properties to convey additional information, such as directionality. Further, rear protective element 802 can include one or more light sources, such as light sources 810. The light sources 810 can include one or more lamps, e.g., light emitting diodes, that can be of the same or varying colors. In some implementations, the light sources 810 can be focused at one or more points beyond the rear protective element 802. The light sources 810 can be actuated by one or more controls and/or by one or more sensors included on the head protection device.

The rear protective element 802 also can include other accessories and/or functional devices, including one or more sensors, speakers, cameras, memories, and microphones. Further, the rear protective element can include one or more surface features, such as a channel, ridge, dimples, or bumps. As discussed above, one or more accessories and/or functional devices also can be included in a cushioning element, e.g., if a protective element is not included in that location on a head protection device.

Additionally, rear protective element 802 can include a power source compartment 812 in which one or more power sources 814 can be housed. The one or more power sources 814 can be permanently embedded or removable. Further, the one or more power sources 814 can be rechargeable or disposable. Any power source sufficient to power an accessory, e.g., an LED light source, can be contained in the power source compartment 812, including one or more batteries and/or one or more super capacitors. The power source compartment 812 can include a door or lid, e.g., to protect the wearer from the one or more power sources 814. In some implementations, the power source compartment 812 also can be water resistant or water proof.

The protective, cushioning, and functional elements described above are representative. An element or combination of elements can be placed anywhere on a head protection device. For example, a front protective element and front cushioning element can be modified, e.g., in shape and/or size, to conform to another region of the head, such as a location in the temporal or parietal region, and attached to a corresponding portion of the head protection device.

While the present disclosure describes numerous implementations and features, it will be understood by those skilled in the art that various changes may be made to these implementations and features, and that equivalent elements may be substituted for those described without departing from the disclosure. Further, it is noted that aspects and features of one implementation could be used to replace or augment aspects and features of other implementations without departing from the intended scope. In addition, one or more modifications could be made to adapt a particular situation, material, or technique to the present disclosure without departing from its intended scope. Therefore, it is intended that the present disclosure not be limited to the particular implementations, arrangements, and features disclosed, but rather that the present disclosure be understood to be broad enough to encompass all embodiments and implementations that fall within the scope of the appended claims.

What is claimed is:

1. A head protection device, comprising:

a flexible shell, comprised of at least an interior layer and an exterior layer, having one or more exterior exposed regions and one or more corresponding interior exposed regions, wherein the one or more exterior exposed regions and the one or more corresponding interior exposed regions are aligned and are not covered by an element of the head protection device;

a protective element coupled to an exterior portion of the shell, forming a protective region;

an intermediate element situated between the interior layer and the exterior layer; and a cushioning element, separate from the protective element, coupled to an interior portion of the shell and at least partially overlapping the protective region;

wherein the protective element provides regionalized protection while leaving at least another portion of the shell unprotected.

2. The head protection device of claim 1, wherein either or both of the protective element and the cushioning element is removably coupled to the shell.

3. The head protection device of claim 1, wherein the protective element includes at least one seam along which the protective element can bend.

4. The head protection device of claim 1, wherein the protective element comprises a first piece and a second piece, the first and second pieces being configured such that the first piece partially overlaps the second piece.

5. The head protection device of claim 1, wherein the protective element includes a recessed portion.

6. The head protection device of claim 1, wherein the protective element and the cushioning element are detachably coupled to one another through an opening in the shell.

7. The head protection device of claim 1, wherein the intermediate element comprises a second protective element.

8. The head protection device of claim 1, wherein a light source and a power source are integrated into the first protective element.

9. A head protection system, comprising:

a flexible shell, comprised of at least an interior layer and an exterior layer, adapted to conform to at least a portion of a user's head, the flexible shell comprising one or more exterior exposed regions that are not covered by an element of the head protection system;

a first protective element coupled to an exterior portion of the flexible shell and a first cushioning element coupled to an interior portion of the flexible shell, such that the first cushioning element is aligned with and at least partially overlapping the first protective element to form a first protective region;

an intermediate cushioning element situated between the interior layer and the exterior layer; and a second protective element coupled to a second exterior portion of the flexible shell and a second cushioning element coupled to a second interior portion of the flexible shell, such that the second cushioning element is aligned with and at least partially overlapping the second protective element to form a second protective region;

wherein the first protective region and the second protective region correspond to separate portions of the flexible shell.

10. The head protection system of claim 9, further comprising a securing post detachably coupling the first protective element to the first cushioning element.

11. The head protection system of claim 10, wherein the flexible cap further comprises an alignment guide to facilitate alignment of at least one of the first protective element or the first cushioning element.

12. The head protection system of claim 9, wherein the first cushioning element comprises a first compressible layer having a first density and a second compressible layer having a second density.

13. The head protection system of claim 9, wherein the first protective element further comprises an integrated light source.

14. The head protection system of claim 13, wherein the first protective element further comprises an integrated power source.

15. The head protection system of claim 9, wherein the first protective element further comprises an integrated reflector.

16. The head protection system of claim 9, wherein the first protective element and second protective element are comprised of different materials.

17. A head protection device, comprising:

a flexible cap, comprising and interior layer and an exterior layer, wherein the flexible cap is constructed of a material having a degree of elasticity and has an exterior surface and an interior surface, and the flexible cap is adapted to be worn on a human head such that at least a portion of the interior surface contacts the human head;

an intermediate cushioning element situated between the interior layer and the exterior layer;

a protective element constructed of at least one hardened material, the protective element being coupled to and covering a portion of the exterior surface of the flexible cap, the protective element forming a protective region; and a cushioning element, separate from the protective element, formed from at least one resilient material and coupled to the interior surface of the flexible cap, the cushioning element at least partially overlapping the protective region;

wherein the protective region covers only a portion of the exterior surface of the flexible cap and the cushioning element covers only a portion of the interior surface of the flexible cap, leaving another corresponding portion of both the exterior surface and the interior surface of the flexible cap unprotected.

* * * * *